US006027377A

United States Patent [19]

Wang

[11] Patent Number: 6,027,377

[45] Date of Patent: Feb. 22, 2000

[54] PLUG TERMINAL MOUNTING ARRANGEMENT OF AN ELECTRIC PLUG FOR A TRAILER

[76] Inventor: Jen-Ching Wang, No. 27, Alley 4, Lane 446, Fu Hsin Rd., Shu Lin Chen, Taipei County, Taiwan

[21] Appl. No.: 09/090,397

[22] Filed: Jun. 4, 1998

[51] Int. Cl.[7] ..... H01R 13/04

[52] U.S. Cl. ..... 439/692; 439/35

[58] Field of Search ..... 439/34, 35, 692, 439/36, 651, 655, 933, 934, 801, 802, 638, 641, 643, 105, 106, 693, 694, 503, 502, 505

[56] References Cited

U.S. PATENT DOCUMENTS

| | | | |
|---|---|---|---|
| 4,390,226 | 6/1983 | Hohn | 439/261 |
| 4,770,644 | 9/1988 | Feder | 439/166 |
| 5,522,740 | 6/1996 | Plocek et al. | 439/752 |
| 5,626,479 | 5/1997 | Hughes | 439/35 |
| 5,800,188 | 9/1998 | Barber et al. | 439/142 |

*Primary Examiner*—Paula Bradley
*Assistant Examiner*—Ross Gushi
*Attorney, Agent, or Firm*—Varndell & Varndell, PLLC

[57] ABSTRACT

A plug terminal mounting arrangement includes a terminal holder base holding six terminals in respective terminal slots thereon. A U-shaped metal plate and a metal connecting block are fastened to front and rear side walls of the terminal holder base. Six U-shaped locating plates are respectively coupled between adjacent V-shaped locating blocks at the rear side of the terminal holder base. A seven-line power cord has seven wires respectively connected to the metal connecting blocks and the terminals. The V-shaped locating blocks have a partition board arranged between the legs of the V-shape for preventing the U-shaped locating plates from contacting one another. The terminal slots of the terminal holder base each having a rectangular cross section at one end adjacent the front side wall of the terminal holder base, and a T-shaped cross section at an opposite end adjacent the rear side wall of the terminal holder base. This structure of the terminal slots assists in proper location of the terminal within the terminal slots when the terminals are inserted into the terminal slots and pressed forward by a press.

1 Claim, 8 Drawing Sheets

PLUG TERMINAL MOUNTING ARRANGEMENT OF AN ELECTRIC PLUG FOR A TRAILER

BACKGROUND AND SUMMARY OF THE INVENTION

The present invention relates to an electric plug for mounting on a trailer, for example, a wagon or car for connection to an electric socket on, for example, an automobile, truck or tractor, and more specifically to the plug terminal mounting arrangement for an electric plug for a trailer.

FIGS. 1 and 2 show a plug terminal mounting arrangement for an electric plug for a trailer according to the prior art. This arrangement is comprised of a terminal holder base, a holding down plate, six terminals, six U-shaped locating plates, screws, a U-shaped metal plate, a metal coupling screw, and a metal connecting block. According to this arrangement, the holding down plate comprises a plurality of V-shaped locating blocks raised from the top side thereof around the border. The U-shaped locating plates are respectively mounted between each two adjacent V-shaped locating blocks to hold the terminals respectively. The terminals each have a screw hole at one end respectively fastened to the U-shaped locating plates by a respective screw, and a locating hole on the middle. The metal connecting block and the U-shaped metal plate are fastened to both sides of the terminal holder base by the metal coupling screw. The terminal holder base comprises six equiangularly spaced hooked portions respectively and partially projecting into respective terminal slots thereon. When the terminals are mounted in the terminal slots on the terminal holder base, the hooked portions are respectively hooked in the locating holes on the terminals to hold terminals in place. When a 7-line power cord is installed, one wire of the 7-line power cord is fastened to the metal connecting block by a tightening up screw, and the other wires of the 7-line power cord are respectively secured to the terminals by the U-shaped locating plates and the respective screws. One drawback of this plug terminal mounting arrangement is its complicated assembly procedure. When mounting the holding down plate on the terminal holder base, the angular position of the holding down plate must be accurately aligned. If the holding down plate is not accurately set into position, the terminals will be forced out of position. Another drawback of this plug terminal mounting arrangement is that the U-shaped locating plates tend to be forced to contact with one another, causing a short circuit. Furthermore, when fastening up the screws to fix the wires of the 7-line power cord to the terminals and the metal connecting block, the terminals may be forced to contact one another, causing a short circuit.

The present invention has been accomplished to provide a plug terminal mounting arrangement which eliminates the aforesaid drawbacks. According to one aspect of the present invention, the plug terminal mounting arrangement comprises a terminal holder base holding six terminals in respective terminal slots thereon, a U-shaped metal plate and a metal connecting block fastened to front and rear side walls of the terminal holder base by a metal coupling screw, six U-shaped locating plates respectively coupled between each two adjacent V-shaped locating blocks at the rear side of the terminal holder to hold the terminals in place, and a 7-line power cord having 7 wires respectively connected to the metal connecting blocks and the terminals, wherein the V-shaped locating blocks are integral with the rear side wall of the terminal holder base, each V-shaped locating block having a partition board on the middle, the partition boards of the V-shaped locating blocks being respectively spaced between each two adjacent U-shaped locating plate to prevent the U-shaped locating plates from contacting one another. According to another aspect of the present invention, the terminal slots of the terminal holder base each have a rectangular cross section at one end extended to the front side wall of the terminal holder base, and a T-shaped cross section at an opposite end extended to the rear side wall of the terminal holder base, the T-shaped cross section of the terminal slots stopping the coupling portions of the terminals from passing through when the terminals are inserted through the rectangular cross sections into the terminal slots and be simultaneously pressed forwards by a press.

DETAILED DESCRIPTION OF THE PREFERRED EMBODIMENT

Figure 1:
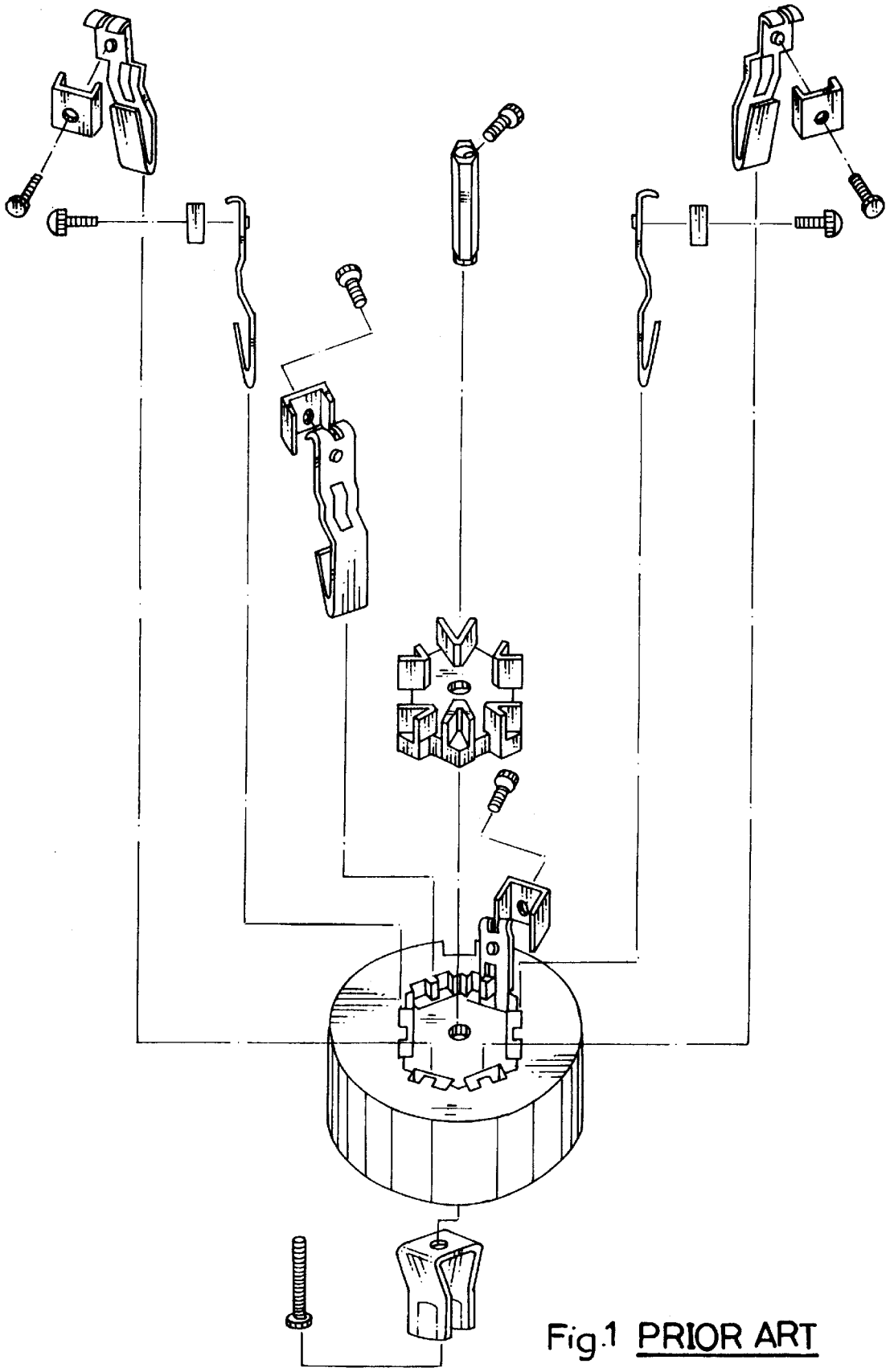
Fig.1 PRIOR ART
FIG. 1 is an exploded view of a plug terminal mounting arrangement for an electric plug according to the prior art.
Figure 2:
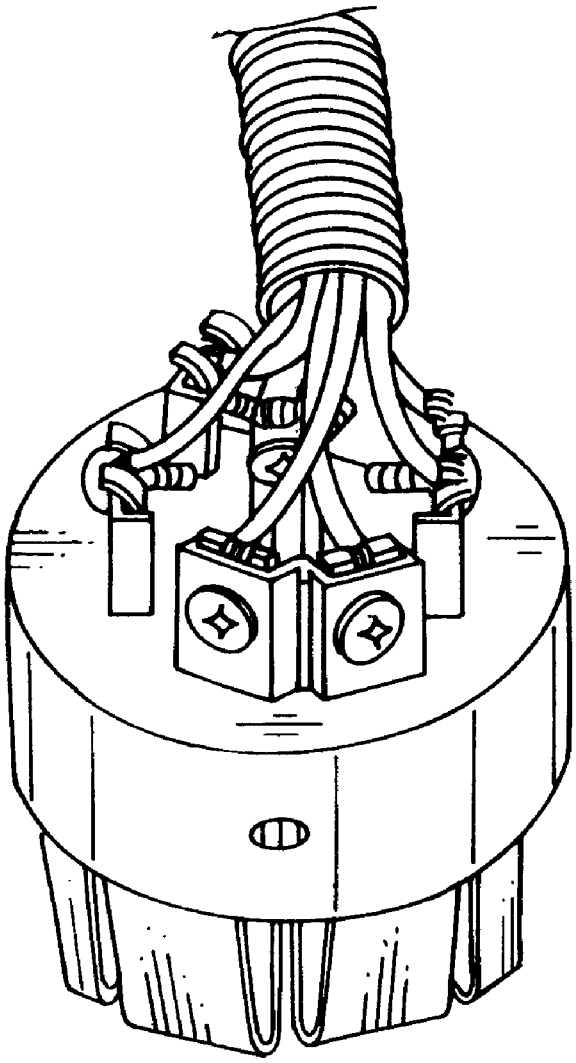
Fig. 2 PRIOR ART
FIG. 2 is a sectional assembly view of FIG. 1, showing the power cord connected.

Referring to FIGS. from 3 to 8, the present invention is generally comprised of an electrically insulative terminal holder base 1, six terminals 2, six U-shaped locating plates 3, a plurality of screws 41; 42, a substantially U-shaped metal plate 5, a coupling screw 6, and a metal connecting block 7.

Figure 3:
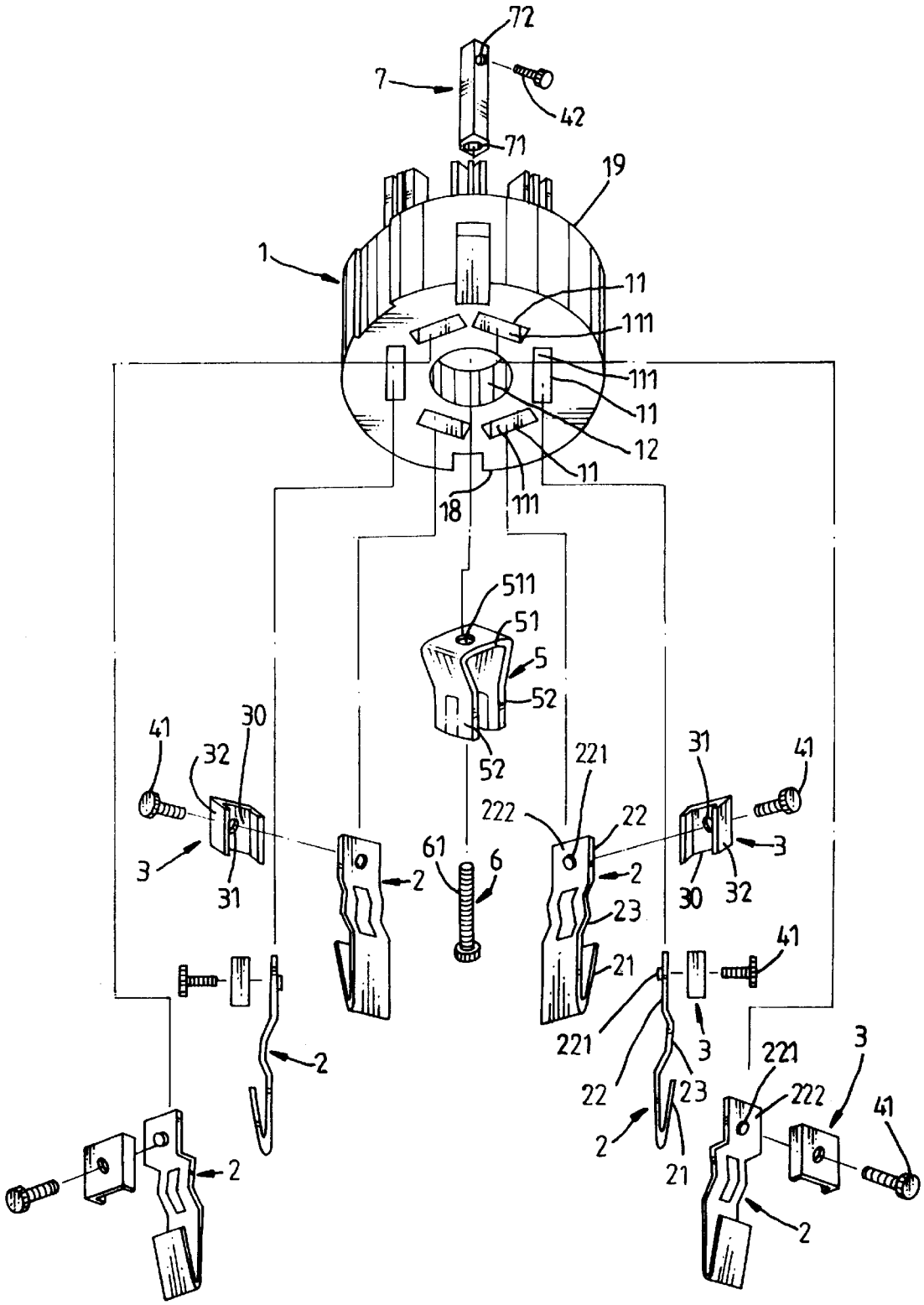
FIG. 3 is an exploded view of a plug terminal mounting arrangement for an electric plug according to the present invention.
Figure 4:
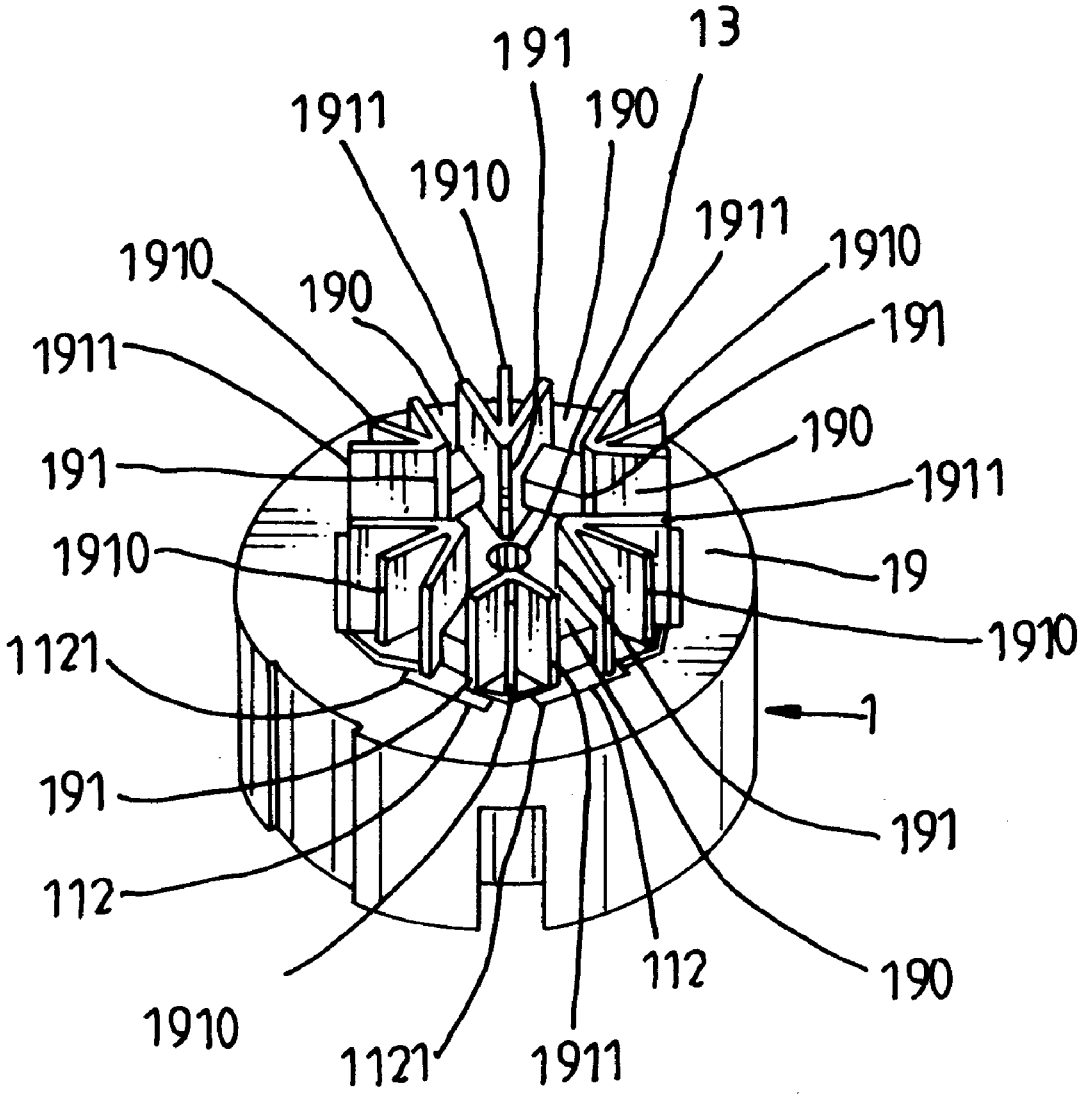
FIG. 4 is a perspective view of the terminal holder base shown in FIG. 3 when viewed from another side.

Referring to FIGS. 3 and 4, the terminal holder base 1 comprises a front side wall 18, a rear side wall 19, a circular recessed hole 12 at the center of the front side wall 18, six terminal slots 11 equiangularly spaced around the circular recessed hole 12 and pierced through the front side wall 18 and the rear side wall 19, a center axle hole 13 disposed at the center of the rear side wall 19 and axially extended to the center of the circular recessed hole 12, six V-shaped locating blocks 191 raised from the rear side wall 19 and equiangularly spaced around the center axle hole 13, and six receiving spaces 190 respectively defined between each two adjacent V-shaped locating blocks 191 for receiving the terminals 2 respectively.

Referring to FIGS. from 3 to 6, the terminals 2 are respectively mounted in the terminal slots 11. Each terminal 2 comprises a curved intermediate portion 23 retained inside one terminal slot 11, a coupling portion 22 at one end protruded from the rear side wall 19 of the terminal holder base 1 and stopped at one side wall 1911 of one V-shaped locating block 191, the coupling portion 22 having a screw hole 221 connected to one U-shaped locating plate 3, and a hooked contact portion 21 at an opposite end protruded from the front side wall 18 of the terminal holder base 1.

Figure 5:
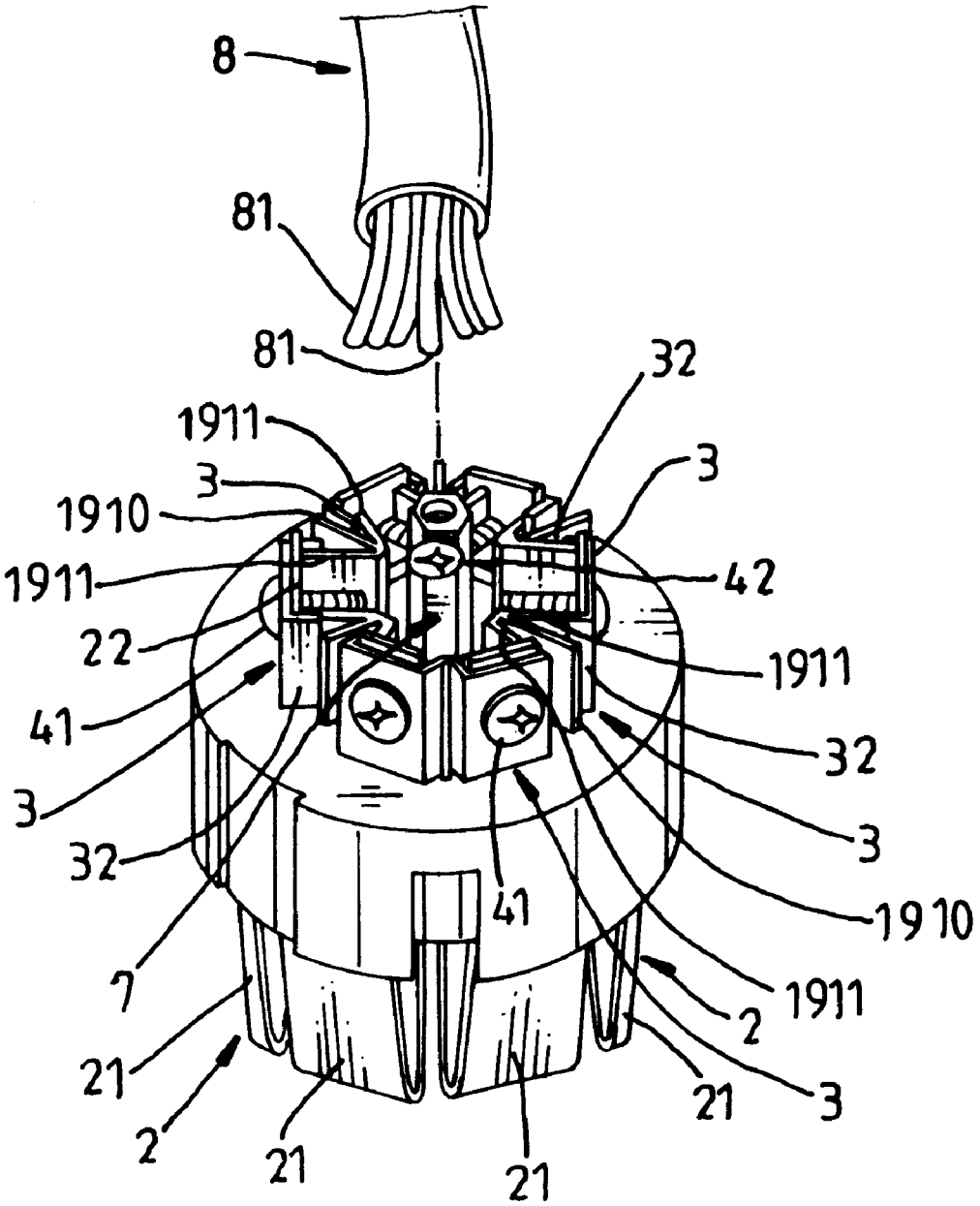
FIG. 5 is a perspective assembly view of FIG. 3 before the connection of the power cord.
Figure 6:
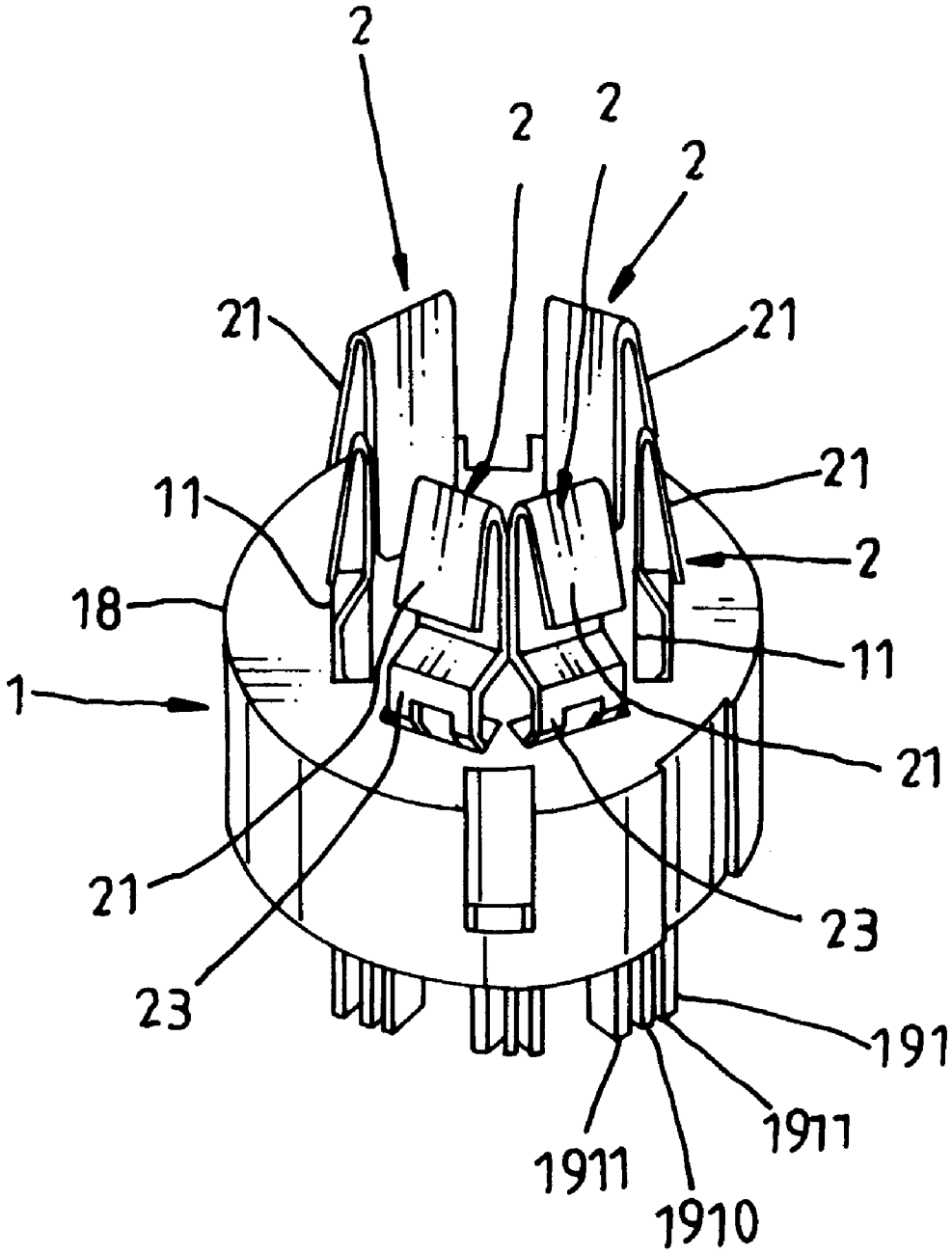
FIG. 6 shows the terminals partially inserted into the terminal slots on the terminal holder base according to the present invention.
Figure 7:
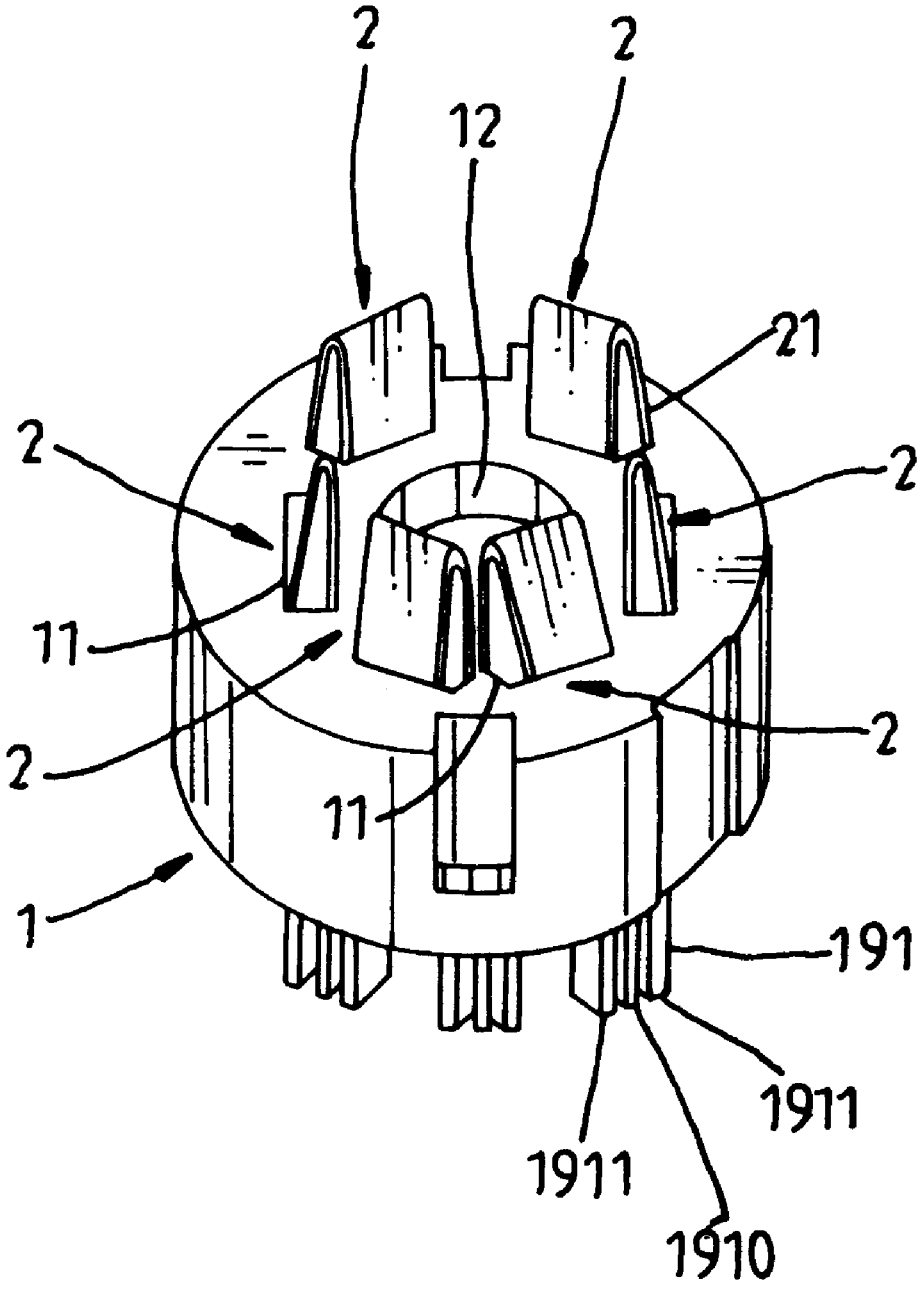
FIG. 7 shows the terminals well installed in the terminal slots on the terminal holder base according to the present invention.
Figure 8:
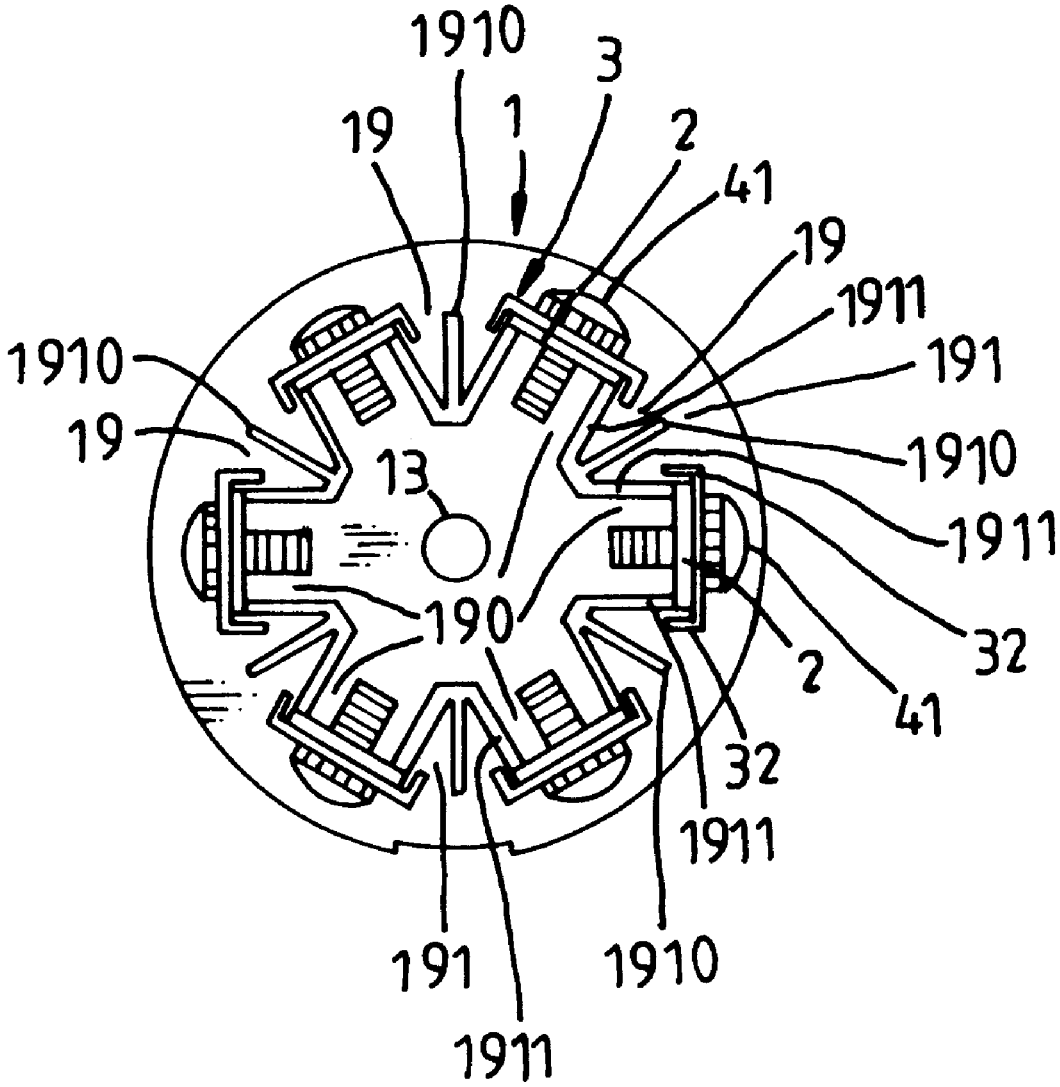
FIG. 8 is a rear side view of present invention before the installation of the metal connecting block.

Referring to FIGS. 3 and 5, the U-shaped locating plates 3 are electrically conductive plates, each having a through hole 31 respectively fastened to the screw holes 221 on the coupling portions 22 of the terminals 2 by a respective metal screw 41.

Referring to FIGS. 3, the U-shaped metal plate 5 is mounted in the circular recessed hole 12 at the center of the front side wall 18 of the terminal holder base 1, comprised of a flat base 51, and two side walls 52 perpendicularly raised from two opposite ends of the flat base 51. The flat base 51 of the U-shaped metal plate 5 has a center hole 511.

Referring to FIGS. 3 and 5, the coupling screw 6 is inserted through the center hole 511 on the flat base 51 of the U-shaped metal plate 5 and the center axle hole 13 on the terminal holder base 1, and connected to the connecting block 7 to fix the U-shaped metal plate 5 to the terminal holder base 1. In FIG. 5 one of the V-shaped locating blocks 191 together with the partition 1910 therfor has been removed, so that the location and arrangement of the connecting block 7 can be better seen. FIG. 5 also shows that if the V-shaped locating block is not present, the U-shaped plates 3 can contact one another.

Referring to FIGS. 3 and 5, the metal connecting block 7 comprises a longitudinally extended screw hole 71 threaded onto the threaded stem 61 of the coupling screw 6, and a transversely extended screw hole 72 perpendicularly extended from the longitudinally extended screw hole 71 to one peripheral wall thereof. Further, a tightening up screw 42 is threaded into the transversely extended screw hole 71 on the connecting block 7.

Referring to FIGS. 3 and 5, when the metal screws 41 are loosened from the U-shaped locating plates 3 and the terminals 2, the six wires 81 of a 7-line power cord 8 are respectively inserted in between the coupling portions 22 of the terminals 2 and the inside wall 30 of the U-shaped locating plates 3, and then the metal screws 41 are fastened tight again to fix six wires 81 of the 7-line power cord 8 to the terminals 2 and the U-shaped locating plates 3, and the last wire of six wires 81 of the 7-line power cord 8 is inserted into the longitudinally extended screw hole 71 of the metal connecting block 7 and fixed in place by the tightening up screw 42.

Referring to FIGS. 3, 4, 7 and 8, the V-shaped locating blocks 191 are integral with the rear side wall 19 of the terminal holder base 1, each having a partition board 1910 on the middle. The partition boards 1910 of the V-shaped locating block 191 are respectively spaced between each two adjacent U-shaped locating plates 3, to prevent direction contact of the side walls 32 of one U-shaped locating plate 3 with another (see FIG. 8). The terminal slots 11 each comprised of a rectangular cross section 111 at one end extended to the front side wall 18 of the terminal holder base 1, and a T-shaped cross section 112 at an opposite end extended to the rear side wall 19 of the terminal holder base 1 (see FIG. 3). The narrow portion 1121 of the T-shaped cross section 112 of each terminal slots 11 is slightly thinner than the thickness of the flat wall 222 of the coupling portion 22 of each terminal 2. When the coupling portions 22 of the terminals 2 are respectively inserted through the rectangular cross sections 111 into the terminal slots 11, the flat walls 222 of the coupling portions 22 of the terminals 2 are stopped from passing through the T-shaped cross sections 112 of the terminal slots 11.

At this time, a press is used to force the terminals 2 in the terminal slots 11, causing the coupling portions 22 of the terminals 2 to pass through the T-shaped cross sections 112 of the terminal slots 11 and to be protruded from the rear side wall 19 of the terminal holder base 1. When assembled, the hooked contact portions 21 of the terminals 2 are retained outside the front side wall 18 of the terminal holder base 1.

I claim:

1. A plug terminal mounting arrangement comprising:

an electrically insulative terminal holder base, said terminal holder base comprising a front side wall, a rear side wall, a circular recessed hole at a center of said front side wall, six terminal slots equiangularly spaced around said circular recessed hole and passing through said front side wall and said rear side wall, a center axle hole disposed at a center of said rear side wall and axially extending to a center of said circular recessed hole, six V-shaped locating blocks raised from said rear side wall and equiangularly spaced around said center axle hole, and six receiving spaced respectively defined between each two adjacent V-shaped locating blocks;

six terminals respectively mounted in said terminal slots on said terminal holder base, said terminals each comprising a curved intermediate portion retained inside one terminal slot on said terminal holder base, a coupling portion at one end protruding from said rear side wall of said terminal holder base and adbutting one side wall of one of said V-shaped locating blocks, said coupling portion having a screw hole, and a hooked contact portion at an opposite end protruding from said front side wall of said terminal holder base;

six electrically conductive U-shaped locating plates respectively coupled between each two adjacent V-shaped locating blocks on said terminal holder base, said U-shaped locating plates each having a through hole respectively fastened to said screw holes on said coupling portions of said terminals by a respective metal screw;

a U-shaped metal plate mounted in said circular recessed hole at said center of said front side wall of said terminal holder base, said U-shaped metal plate comprised of a flat base, and two side walls perpendicularly raised from two opposite ends of said flat base, said flat base of said U-shaped metal plate having a center hole;

a metal connecting block fastened to said rear side wall of said terminal holder base, said metal connecting block comprising a longitudinally extended screw hole, and a transversely extended screw hole perpendicuarly extended from said longitudinally extended screw hole to one peripheral wall thereof;

a coupling screw inserted through said center hole on said flat base of said U-shaped metal plate and said center axle hole on said terminal holder base, and threaded into said longitudinally extended screw hole of said metal connecting block to fix said U-shaped metal plate and said metal connecting block to said front and rear side walls of said terminal holder base;

a seven-line power cord having six wires respectively retained between said coupling portions of said terminals and said U-shaped metal locating plates, and a single wire inserted into said longitudinally extended screw hole of said metal connecting block; and a tightening up screw threaded into said transversely extended screw hole on said metal connecting block to fix said single wire of said seven-line power cord to said metal connecting block;

wherein said V-shaped locating blocks are integral with said rear side wall of said terminal holder base, said V-shaped locating blocks respectively having two flat walls forming sides of the V-shape and a partition board arranged between said flat walls, said partition boards of said V-shaped locating blocks having a structure and being respectively spaced between each two adjacent U-shaped locating plates for preventing said U-shaped locating plates from contacting one another; said terminal slots of said terminal holder base respectively comprising a rectangular cross section at one end adjacent said front side wall of said terminal holder base and a T-shaped cross section at an opposite end adjacent said rear side wall of said terminal holder base, said T-shaped cross section of said terminal slots preventing said coupling portions of said terminals from passing through said terminal slots when said terminals are inserted through said rectangular cross sections into said terminal slots, and said T-shaped cross section of said terminal slots only allowing said coupling portions of said terminals to pass through said terminal slots when said terminals are inserted through said rectangular cross sections by a press whereby said terminals are held in said terminal slots.

* * * * *